US010439333B2

(12) United States Patent
Chalas et al.

(10) Patent No.: US 10,439,333 B2
(45) Date of Patent: Oct. 8, 2019

(54) SHIELDED VERTICAL HEADER

(71) Applicant: TE CONNECTIVITY CORPORATION, Berwyn, PA (US)

(72) Inventors: Guadalupe Chalas, Harrisburg, PA (US); Douglas John Hardy, Middletown, PA (US); John Wesley Hall, Harrisburg, PA (US); Galen M. Martin, Mechanicsburg, PA (US); Neil Franklin Schroll, Mount Joy, PA (US)

(73) Assignee: TE Connectivity, Berwyn, PA (US)

( * ) Notice: Subject to any disclaimer, the term of this patent is extended or adjusted under 35 U.S.C. 154(b) by 0 days.

(21) Appl. No.: 15/883,884

(22) Filed: Jan. 30, 2018

(65) Prior Publication Data

US 2019/0237910 A1 Aug. 1, 2019

(51) Int. Cl.

| | |
|---|---|
| ***H01R 13/648*** | (2006.01) |
| ***H01R 12/00*** | (2006.01) |
| ***H01R 13/6585*** | (2011.01) |
| ***H01R 13/659*** | (2011.01) |
| ***H01R 13/6461*** | (2011.01) |
| ***H01R 12/58*** | (2011.01) |
| ***H01R 12/57*** | (2011.01) |
| ***H01R 13/6594*** | (2011.01) |
| ***H01R 12/71*** | (2011.01) |

(52) U.S. Cl.

CPC ..... *H01R 13/6585* (2013.01); *H01R 12/57* (2013.01); *H01R 12/58* (2013.01); *H01R 12/716* (2013.01); *H01R 13/6461* (2013.01); *H01R 13/659* (2013.01); *H01R 13/6594* (2013.01)

(58) Field of Classification Search

CPC ..... H01R 13/6585; H01R 23/688; H01R 13/514; H01R 13/658; H01R 13/6594; H01R 13/648; H01R 12/737; H01R 13/6485; H01R 4/64; H01R 13/6581

See application file for complete search history.

(56) References Cited

U.S. PATENT DOCUMENTS

| | | | | |
|---|---|---|---|---|
| 5,080,611 A * | 1/1992 | Hypes | H01R 12/716 | 439/554 |
| 5,913,690 A * | 6/1999 | Dechelette | H01R 23/6873 | 439/108 |
| 6,129,555 A * | 10/2000 | Daikuhara | H05K 1/0219 | 439/60 |
| 6,478,623 B1 * | 11/2002 | Wu | H01R 13/6582 | 439/607.35 |

(Continued)

*Primary Examiner* — Xuong M Chung Trans

(57) ABSTRACT

An electrical connector which includes a housing having a first side wall, a second side wall and end walls. A mating connector receiving cavity is provided between the first side wall and the second side wall. Terminals are positioned in the mating connector receiving cavity. A shield receiving area is provided on the first side wall and has shield receiving slots which extend through the first side and open into the mating connector receiving cavity. An outer shield member is positioned in the shield receiving area. The outer shield has end sections which extend essentially perpendicular to a planar section. The end sections extend into the mating connector receiving cavity through the shield receiving slots. Inner shield members are positioned in the mating connector receiving cavity. The inner shield members extend between the terminals to facilitate signal integrity.

13 Claims, 7 Drawing Sheets

(56) References Cited

U.S. PATENT DOCUMENTS

| | | | | |
|---|---|---|---|---|
| 7,785,148 | B2 * | 8/2010 | Pan | H01R 13/514<br>439/607.06 |
| 8,105,112 | B2 * | 1/2012 | Midorikawa | H01R 13/6582<br>439/607.35 |
| 8,562,374 | B2 | 10/2013 | Myer et al. | |

* cited by examiner

SHIELDED VERTICAL HEADER

FIELD OF THE INVENTION

The present invention is directed to a shielded vertical header. In particular, the invention is directed to a single row shielded vertical header with shielding on three sides of each electrical contact to maintain the desired signal integrity of the contacts.

BACKGROUND OF THE INVENTION

Signal loss and/or signal degradation is a problem in known electrical systems. For example, cross talk results from an electromagnetic coupling of the fields surrounding an active conductor or differential pair of conductors and an adjacent conductor or differential pair of conductors. The strength of the coupling generally depends on the separation between the conductors, thus, cross talk may be significant when the electrical connectors are placed in close proximity to each other. The strength of the coupling also depends on the material separating the conductors.

As speed and performance demands increase, known electrical connectors are proving to be insufficient. Additionally, there is a desire to increase the density of electrical connectors to increase throughput of the electrical system without an appreciable increase in size of the electrical connectors. Such increase in density without increase in size causes further strains on performance.

This is particularly true in the automotive industry in which digitization and connectivity are becoming more important. Automotive Ethernet provides the ability to provide new functions based on networking individual functions/systems, on re-using sensor signals and on communicating with a backend view the cloud. This requires high-bandwidth, high-frequency data transmission to facilitate such connectivity.

To enable this high-bandwidth, high-frequency data transmission, it would be beneficial to have electrical connectors which are properly shielded, robust, reliable, miniaturized and scalable.

SUMMARY OF THE INVENTION

An embodiment is directed to an electrical connector which includes a housing having a first side wall, a second side wall and end walls. A mating connector receiving cavity is provided between the first side wall and the second side wall. Terminals are positioned in the mating connector receiving cavity. A shield receiving area is provided on the first side wall. Shield receiving slots extend through the first side and open into the mating connector receiving cavity. An outer shield member is positioned in the shield receiving area. The outer shield is a U-shaped member with end sections which extend essentially perpendicular to a planar section. The end sections extend into the mating connector receiving cavity through the shield receiving slots.

An embodiment is directed to an electrical connector which includes a housing having a first side wall, a second side wall and end walls. A mating connector receiving cavity is provided between the first side wall and the second side wall. Terminals are positioned in the mating connector receiving cavity. A shield receiving area is provided on the first side wall and has shield receiving slots which extend through the first side and open into the mating connector receiving cavity. An outer shield member is positioned in the shield receiving area. The outer shield has end sections which extend essentially perpendicular to a planar section. The end sections extend into the mating connector receiving cavity through the shield receiving slots. Inner shield members are positioned in the mating connector receiving cavity. The inner shield members extend between the terminals to facilitate signal integrity.

An embodiment is directed to an electrical connector which includes a housing having a first side wall, a second side wall and end walls. A mating connector receiving cavity is provided between the first side wall and the second side wall. Solder clip retention projections extend from the end walls proximate a bottom wall of the housing. Terminals are positioned in the mating connector receiving cavity. A shield receiving area is provided on the first side wall and has shield receiving slots which extend through the first side and open into the mating connector receiving cavity. An outer shield member is positioned in the shield receiving area. The outer shield has end sections which extend essentially perpendicular to a planar section. The end sections extend into the mating connector receiving cavity through the shield receiving slots. Inner shield members are positioned in the mating connector receiving cavity. The inner shield members extend between the terminals to facilitate signal integrity. The inner shield members are planar members with mating sections. Solder clips are positioned on the solder clip retention projections. The solder clips are configured to provide support to the housing and allow the housing to withstand pulling forces in all directions without dislodging the housing from a substrate.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
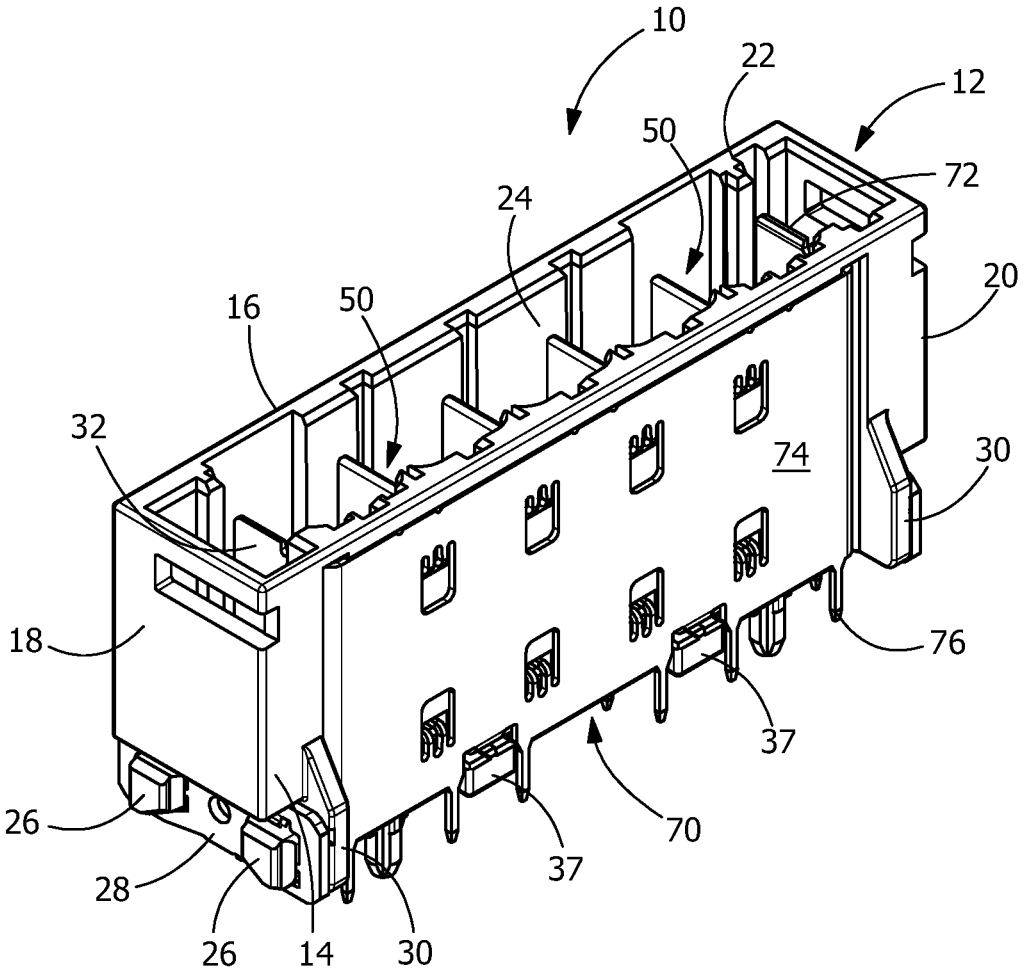
FIG. 1 is a perspective view of an illustrative embodiment of a header according to the present invention.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features, the scope of the invention being defined by the claims appended hereto.

Figure 2:
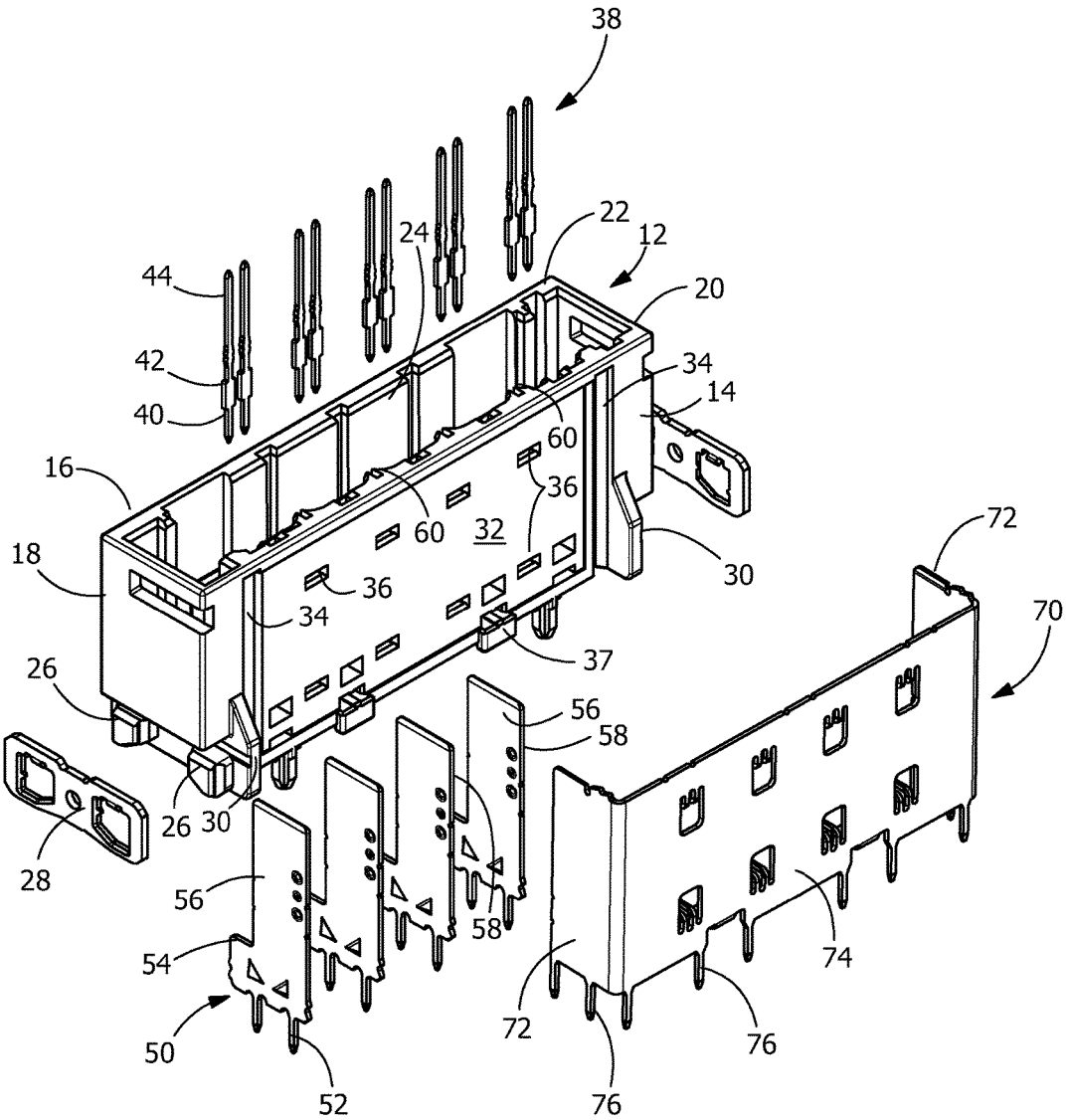
FIG. 2 is an exploded perspective view of the header of FIG. 1.

As best shown in FIGS. 1 and 2, an electrical connector header 10 includes a housing 12 having a first side wall 14 and oppositely facing second side wall 16 and end walls 18, 20 which extend between the first side wall 14 and the second side wall 16. A bottom wall (not shown) extends between the first side wall 14, the second side wall 16 and the end walls 18, 20. A mating connector receiving surface 22 is opposed to the bottom wall. A mating connector receiving cavity 24 extends from the mating connector receiving surface 22 to the bottom wall. The mating connector receiving cavity 24 is bound by the first side wall 14, the second side wall 16 and the end walls 18, 20.

The bottom wall of the header housing 12 is positioned on or proximate to a substrate or printed circuit board (not shown). Solder clip retention projections 26 extend from either end wall 18, 20 proximate the bottom wall. The solder clip retention projections 26 are configured to cooperate with and maintain solder clips 28 on the header 10. The solder clips 28 are configured to be soldered to the substrate or printed circuit board to secure the header housing 12 and the header 10 to the substrate or printed circuit board. The solder clips 28 provide sufficient support to allow the header 10 to withstand pulling forces in all directions with dislodging the header 10 from the substrate or printed circuit board.

Stabilization members 30 extend outward from the first side wall 14 and the second side wall 16. The stabilization members 30 provide the header housing 12 and header 10 with a larger footprint on the substrate or printed circuit board, thereby providing greater stability to the header housing 12 and the header 10.

As best shown in FIG. 2, a shield receiving area 32 is provided on the first side wall 14 of the header housing 12. Shield receiving slots 34 extend through the first side wall 14 proximate the periphery of the shield receiving area 32. The shield receiving slots 34 extend from proximate the mating connector receiving face 22 to proximate the bottom wall of the housing 12. The shield receiving slots 34 extend through the first side wall 14 and open into the mating connector receiving cavity 24.

Shield receiving openings 36 are positioned in the shield receiving area 32 of the first side wall 14. The shield receiving openings 36 are spaced periodically along the shield receiving area 32. The spacing of the shield receiving openings 36 corresponds to the spacing of inner shield members of the header 10, as will be more fully described. A first row of shield receiving openings 36 is proximate to, but spaced from, the mating connector receiving face 22. A second row of shield receiving openings 36 is proximate to, but spaced from, the bottom wall. The shield receiving openings 36 extend through the first side wall 14 and open into the mating connector receiving cavity 24.

Shield receiving projections 37 extend from the first side wall 14 proximate the bottom wall. The shield receiving projections 37 are configured to receive and properly position the outer shield member.

Terminals 38 are positioned in the mating connector receiving cavity 24. Printed circuit board engagement sections 40 of the terminals 38 extend through the bottom wall to make electrical connections with contact pads or openings on the printed circuit board. Retention sections 42 of the terminals 38 cooperate with the bottom wall to secure the terminals 38 in position. Mating connector mating sections 44 are positioned in the mating connector receiving cavity 24 to make electrical connections to the mating connector (not shown).

Figure 3:
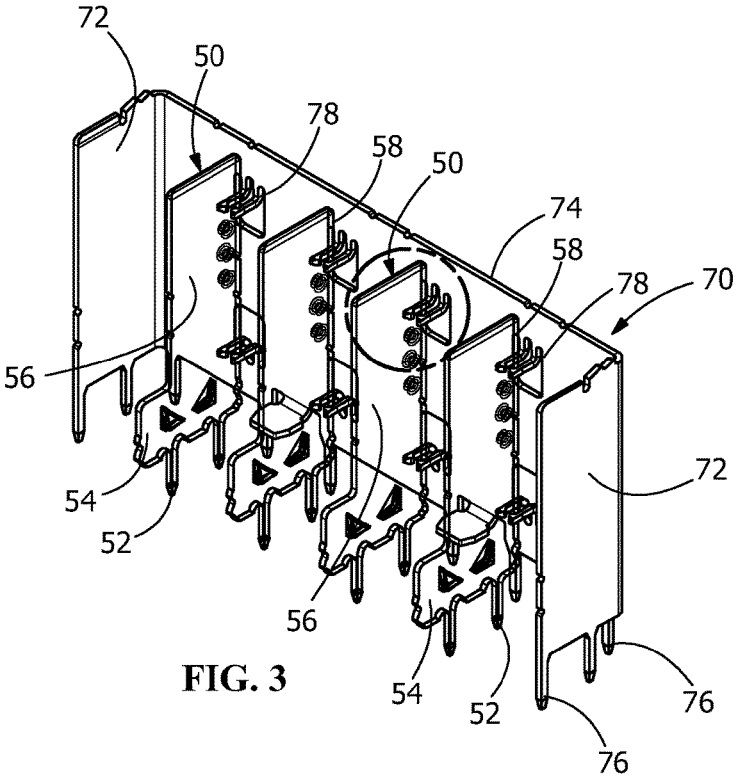
FIG. 3 is a perspective view of the shielding members of the header of FIG. 1, the shielding members are shown without the housing of the header.

Referring to FIG. 1, inner grounding members or shield members 50 are provided in the mating connector receiving cavity 24. In the embodiment shown, the inner shield members 50 extend between mated pairs of terminals 38 to facilitate signal integrity. However, in other embodiments, the inner shield members 50 may extend between individual terminals. As best shown in FIGS. 2 and 3, the inner shield members 50 are planar members which have printed circuit board engagement sections 52 which extend through the bottom wall to make electrical connections with contact pads or openings on the printed circuit board. Retention sections 54 of the inner shield members 50 cooperate with the bottom wall to secure the inner shield members 50 in position. Mating sections 56 are positioned in the mating connector receiving cavity 24 to make electrical connections to shield members of the mating connector (not shown).

Edges 58 of the mating sections 56 of the inner shield members 50 are positioned in shield receiving slots 60 of the first side wall 14. The shield receiving slots 60 are positioned proximate the mating connector receiving cavity 24 and intersect the shield receiving openings 36.

Referring to FIG. 1, an outer grounding member or shield member 70 is provided in the shield receiving area 32 of the housing 12. The outer shield member 70 cooperates with the shield receiving projections 37 to properly position the outer shield member 70 in position relative to the shield receiving area 32 of the housing 12. As best shown in FIGS. 2 and 3, the outer shield member 70 is a U-shaped member with end sections 72 which extend essentially perpendicular to planar section 74. The outer shield member 70 has printed circuit board engagement sections 76 which extend from the ends 72 and the planar section 74 to make electrical connections with contact pads or openings on the printed circuit board.

The end sections 72 of the outer shield member 70 are configured to be inserted into the mating connector receiving cavity 24 through the shield receiving slots 34, thereby providing shielding to the terminals 38 in the mating connector receiving cavity 24 which are positioned proximate respective end walls 18, 20.

Figure 4:
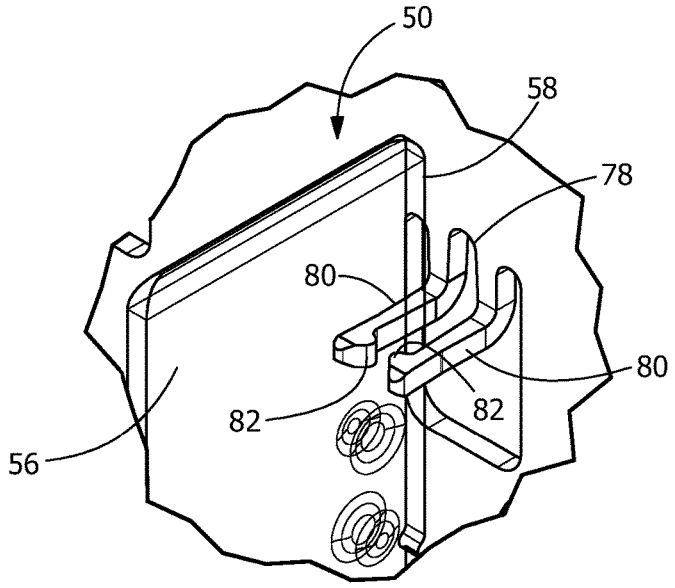
FIG. 4 is an enlarged perspective view showing the mechanical and electrical connection between an outer shielding member and an inner shielding member of the header shown in FIG. 3.

As best shown in FIGS. 3 and 4, the planar sections 74 have inner shield engagement members 78 which are formed from the planar sections 74 and extend from the planar sections 74 in the same direction as the end sections 72. As shown in FIG. 4, each inner shield engagement members 78 includes a pair of arms 80 with facing projections 82. The spacing between the facing projections 82 is less than the thickness of the mating sections 56 of the inner shield members 50.

A first row of inner shield engagement members 78 is positioned to be received in the first row of shield receiving openings 36. A second row of inner shield engagement members 78 is positioned to be received in the second row of shield receiving openings 36. The projections 82 are positioned in the mating connector receiving cavity 24 and mechanically and electrically engage the mating sections 56 of the inner shield members 50.

As the inner shield members 50 and the outer shield member 70 are moved into engagement, the projections 82 of the outer shield member 70 engage the mating sections 56 of the inner shield members 50 proximate the edges 58. As this occurs, the projections 82 are spread apart and wipe across the mating sections 56, thereby removing any contaminants or oxides provided by the projections 82 and the mating sections 56, thereby facilitating that a positive electrical connection will be made and maintained between the projections 82 and the mating sections 56. In addition, as the inner shield members 50 and the outer shield member 70 are moved into engagement, the arms 80 are resiliently deformed, causing the arms 80 and the projections 82 to exert a force on the mating sections, thereby ensuring that outer shield member 70 and the inner shield members 50 will be maintained in mechanical and electrical engagement.

With the inner shield members 50 and outer shield member 70 properly positioned on the housing 12, the inner shield members 50 and outer shield member 70 provide shielding on three sides of each of the pairs of terminals 38. This provides sufficient shielding to allow for proper signal integrity and to allow the header to perform up to 1 Gbps.

Figure 6:
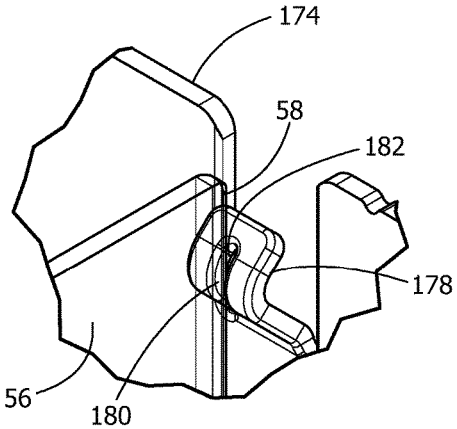
FIG. 6 is an enlarged perspective view showing the mechanical and electrical connection between an outer shielding member and an inner shielding member of the header shown in FIG. 5.
Figure 5:
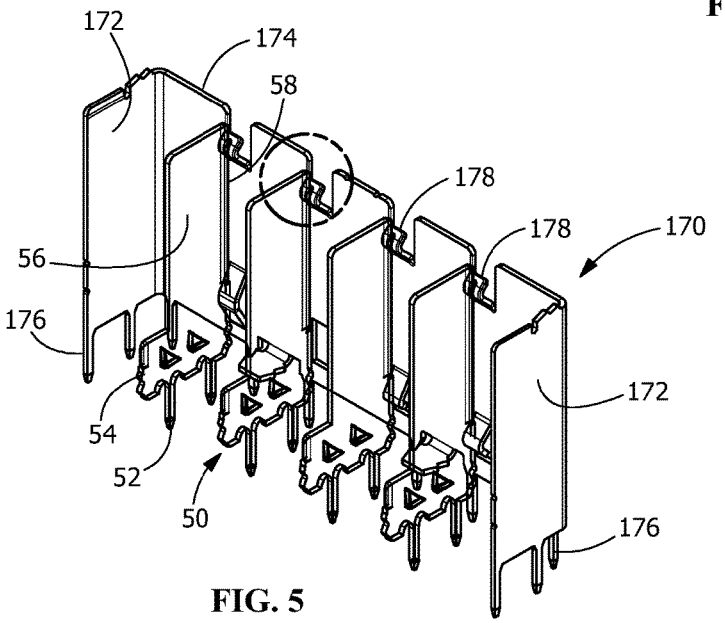
FIG. 5 is a perspective view of a first alternate illustrative shielding members for use with a header similar to that shown in FIG. 1, the shielding members are shown without the housing of the header.

Referring to FIGS. 5 and 6, an alternate embodiment of the outer grounding member or shield 170 is provided. The outer shield 170 is a U-shaped member with end sections 172 which extend essentially perpendicular to planar section 174. The outer shield 170 has printed circuit board engagement sections 176 which extend from the ends 172 and the planar section 174 to make electrical connections with contact pads or openings on the printed circuit board.

The end sections 172 of the outer shield 170 are configured to be inserted into the mating connector receiving cavity 24 through the shield receiving slots 34, thereby providing shielding to the terminals 38 in the mating connector receiving cavity 24 which are positioned proximate respective end walls 18, 20.

The planar sections 174 have inner shield engagement members 178 which are formed from the planar sections 174 and extend from the planar sections 174 in the same direction as the end sections 172. As shown in FIG. 6, each inner shield engagement members 178 includes a slot 180 with facing projections or edges 182. The slot 180 is dimensioned to be approximately equal to but smaller than the thickness of the mating sections 56 of the inner shield members 50.

A first row of inner shield engagement members 178 is positioned to be received in the first row of shield receiving openings 36. A second row of inner shield engagement members 178 is positioned to be received in the second row of shield receiving openings 36. The slots 180 and the projections or edges 182 are positioned in the mating connector receiving cavity 24 and mechanically and electrically engage the mating sections 56 of the inner shield members 50.

As the inner shield members 50 and the outer shield 170 are moved into engagement, the projections or edges 182 of the slot 180 of the outer shield 170 engage the mating sections 56 of the inner shield members 50 proximate the edges 58, causing an interference fit between the mating sections 56 and the slot 180, thereby removing any contaminants or oxides provided the projections or edges 182 and the mating sections 56, thereby facilitating that a positive electrical and mechanical connection will be made and maintained between the projections or edges 182 and the mating sections 156.

With the inner shield members 50 and outer shield 170 properly positioned on the housing 12, the inner shield members 50 and outer shield 170 provide shielding on three sides of each of the pairs of terminals 38. This provides sufficient shielding to allow for proper signal integrity and to allow the header to perform up to 1 Gbps.

Figure 8:
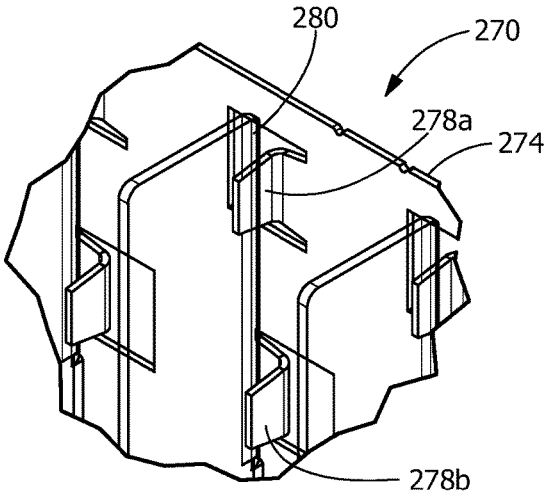
FIG. 8 is an enlarged perspective view showing the mechanical and electrical connection between an outer shielding member and an inner shielding member of the header shown in FIG. 7.
Figure 7:
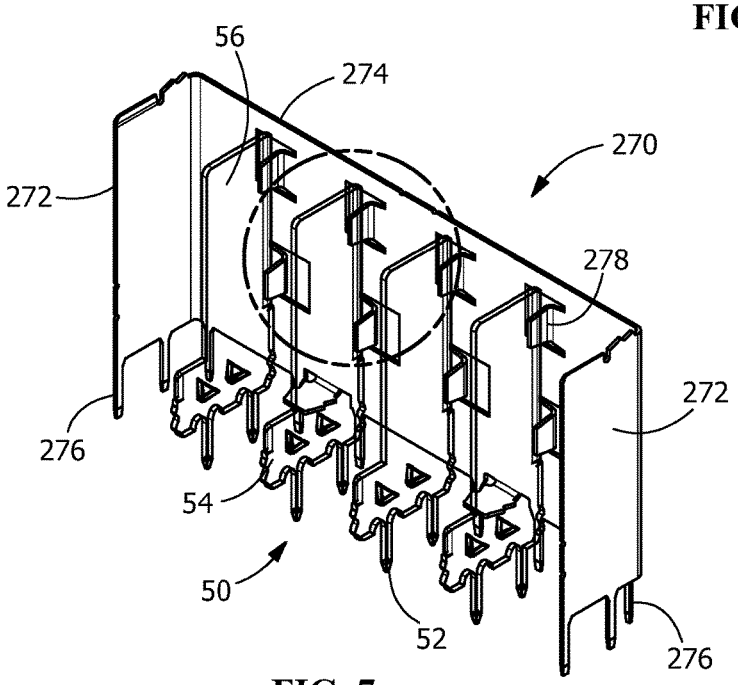
FIG. 7 is a perspective view of a second alternate illustrative shielding members for use with a header similar to that shown in FIG. 1, the shielding members are shown without the housing of the header.

Referring to FIGS. 7 and 8, an alternate embodiment of the outer grounding member or shield 270 is provided. The outer shield 270 is a U-shaped member with end sections 272 which extend essentially perpendicular to planar section 274. The outer shield 270 has printed circuit board engagement sections 276 which extend from the ends 272 and the planar section 274 to make electrical connections with contact pads or openings on the printed circuit board.

The end sections 272 of the outer shield 270 are configured to be inserted into the mating connector receiving cavity 24 through the shield receiving slots 34, thereby providing shielding to the terminals 38 in the mating connector receiving cavity 24 which are positioned proximate respective end walls 18, 20.

The planar sections 274 have inner shield engagement members 278 which are formed from the planar section 274 and extend from the planar sections 274 in the same direction as the end sections 272. As shown in FIG. 8, a first row of inner shield engagement members **278*a* is positioned to be received in the first row of shield receiving openings 36. A second row of inner shield engagement members 278*b* is positioned to be received in the second row of shield receiving openings 36. The shield engagement members 278*a*, 278*b* are formed from the planar section 274 in opposite directions, as shown in FIG. 8, thereby forming an inner shield receiving slot 280 between respective inner shield engagement members 278*a*, 278*b***.

As the inner shield members 50 and the outer shield 270 are moved into engagement, respective inner shield engagement members 278*a*, 278*b* engage the mating sections 56 of the inner shield members 50 proximate the edges 58, causing an interference fit between the mating sections 56 and the respective inner shield engagement members 278*a*, 278*b*, thereby facilitating that a positive electrical and mechanical connection will be made and maintained between the respective inner shield engagement members 278*a*, 278*b* and the mating sections 56.

With the inner shield members 50 and outer shield 270 properly positioned on the housing 12, the inner shield members 50 and outer shield 270 provide shielding on three sides of each of the pairs of terminals 38. This provides sufficient shielding to allow for proper signal integrity and to allow the header to perform up to 1 Gbps.

Figure 10:
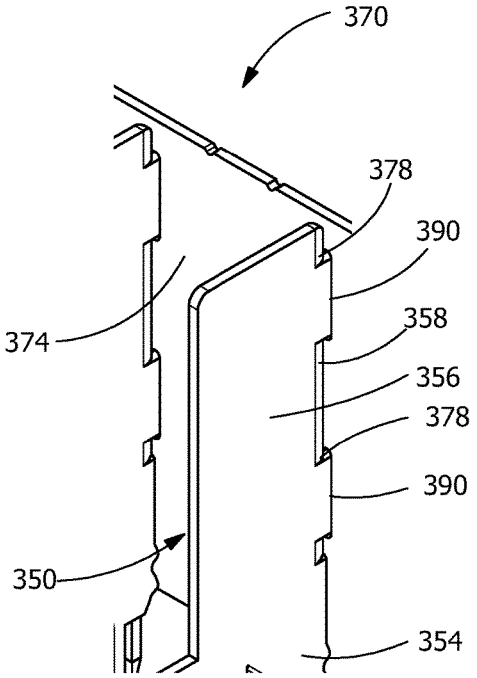
FIG. 10 is an enlarged perspective view showing the mechanical and electrical connection between an outer shielding member and an inner shielding member of the header shown in FIG. 9.
Figure 9:
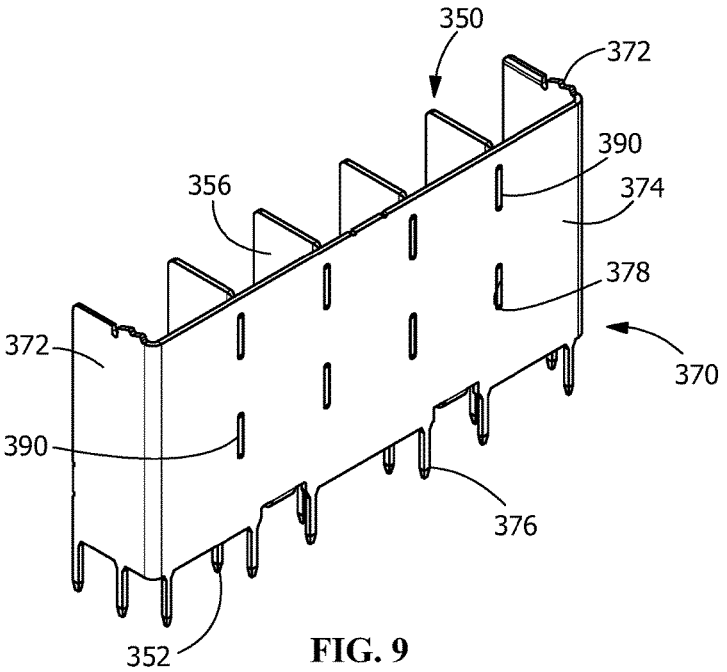
FIG. 9 is a perspective view of a third alternate illustrative shielding members for use with a header similar to that shown in FIG. 1, the shielding members are shown without the housing of the header.

Referring to FIGS. 9 and 10, an alternate embodiment of the inner shield members 350 and the outer grounding member or shield 370 is provided. The inner shield members 350 are planar members which have printed circuit board engagement sections 352 which extend through the bottom wall to make electrical connections with contact pads or openings on the printed circuit board. Retention sections 354 of the inner shield members 350 cooperate with the bottom wall to secure the inner shield members 350 in position. Mating sections 356 are positioned in the mating connector receiving cavity 24 to make electrical connections to shield members of the mating connector (not shown).

The inner shield members have outer shield engagement projections 390 which extend from edges 358 of the mating sections 356. A first row of outer shield engagement projections 390 is positioned to be received in the first row of shield receiving openings 36. A second row of outer shield engagement projections 390 is positioned to be received in the second row of shield receiving openings 36.

The outer shield 370 is a U-shaped member with end sections 372 which extend essentially perpendicular to planar section 374. The outer shield 370 has printed circuit board engagement sections 376 which extend from the ends 372 and the planar section 374 to make electrical connections with contact pads or openings on the printed circuit board.

The end sections 372 of the outer shield 370 are configured to be inserted into the mating connector receiving cavity 24 through the shield receiving slots 34, thereby providing shielding to the terminals 38 in the mating connector receiving cavity 24 which are positioned proximate respective end walls 18, 20.

The planar sections 374 have inner shield engagement openings 378 which are formed from the planar section 274. As shown in FIG. 9, the inner shield engagement openings 378 are positioned to receive the outer shield engagement projections 390 therein.

As the inner shield members 350 and the outer shield 370 are moved into engagement, respective outer shield engagement projections 390 engage the inner shield engagement openings 378, causing an interference fit between the inner shield engagement openings 378 and the outer shield engagement projections 390, thereby facilitating that a positive electrical and mechanical connection will be made and maintained between the respective outer shield engagement projections 390 and the inner shield engagement openings 378.

With the inner shield members 350 and outer shield 370 properly positioned on the housing 12, the inner shield members 350 and outer shield 370 provide shielding on three sides of each of the pairs of terminals 38. This provides sufficient shielding to allow for proper signal integrity and to allow the header to perform up to 1 Gbps.

Figure 12:
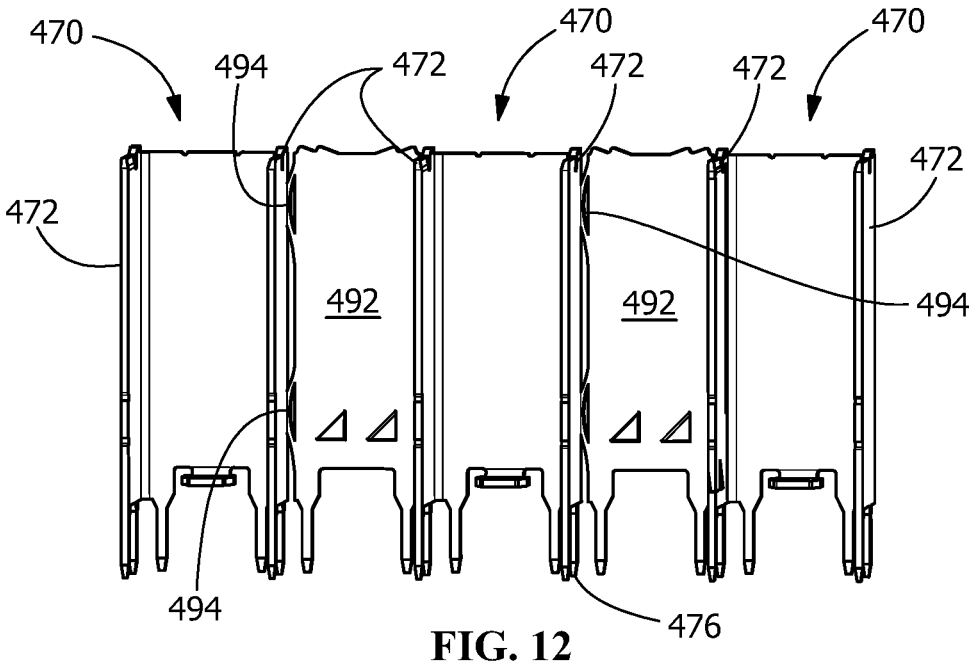
FIG. 12 is an enlarged perspective view showing the mechanical and electrical connection between an outer shielding member and an inner shielding member of the header shown in FIG. 11.
Figure 11:
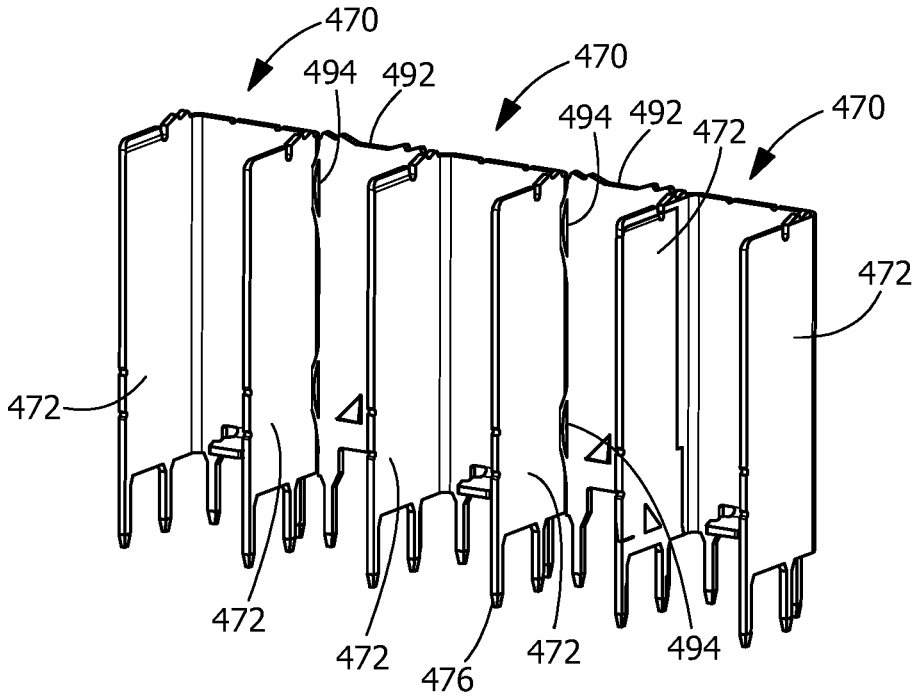
FIG. 11 is a perspective view of a fourth alternate illustrative shielding members for use with a header similar to that shown in FIG. 1, the shielding members are shown without the housing of the header.

Referring to FIGS. 11 and 12, an alternate embodiment of the outer grounding member or shield 470 is provided. The outer shield 470 is a U-shaped member with end sections 472 which extend essentially perpendicular to planar section 474. The outer shield 470 has printed circuit board engagement sections 476 which extend from the ends 472 and the planar section 474 to make electrical connections with contact pads or openings on the printed circuit board.

The end sections 472 of the outer shield members 470 are configured to be inserted into the mating connector receiving cavity 24 through the shield receiving slots 34, thereby providing shielding to the terminals 38 in the mating connector receiving cavity 24 which are positioned proximate respective end walls 18, 20. In this embodiment, a plurality of outer shield members 470 are provided, with each outer shield 470 providing shielding for one pair of terminals. Separate planar outer shield members 492 are provided and extend between respective outer shield members 470. The planar outer shield members 492 have resilient projection 494 which make electrical and mechanical engagement with adjacent outer shield members 470 to provide shielding across the first side surface of the housing.

With the shield members 470, 492 properly positioned on the housing 12, the shield members 470, 492 provide shielding on three sides of each of the pairs of terminals 38. This provides sufficient shielding to allow for proper signal integrity and to allow the header to perform up to 1 Gbps.

While the invention has been described with reference to a preferred embodiment, it will be understood by those skilled in the art that various changes may be made and equivalents may be substituted for elements thereof without departing from the spirit and scope of the invention as defined in the accompanying claims. In particular, it will be clear to those skilled in the art that the present invention may be embodied in other specific forms, structures, arrangements, proportions, sizes, and with other elements, materials and components, without departing from the spirit or essential characteristics thereof. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical connector comprising:

a housing having a first side wall, a second side wall and end walls, a mating connector receiving cavity is provided between the first side wall and the second side wall;

terminals positioned in the mating connector receiving cavity;

a shield receiving area provided on the first side wall, shield receiving slots extend through the first side and open into the mating connector receiving cavity;

shield receiving openings are positioned in the shield receiving area, the shield receiving openings are spaced along the shield receiving area, the shield receiving openings extend through the first side wall and open into the mating connector receiving cavity;

inner shield members are positioned in the mating connector receiving cavity, the inner shield members extend between the terminals to facilitate signal integrity, the inner shield members are planar members with mating sections;

an outer shield member positioned in the shield receiving area, the outer shield is a U-shaped member with end sections which extend essentially perpendicular to a planar section, the end sections extend into the mating connector receiving cavity through the shield receiving slots;

the planar section of the outer shield member has inner shield engagement members which extend from the planar section in the same direction as the end sections, the inner shield engagement members extend through the shield receiving openings and are provided in electrical and mechanical engagement with the mating sections of the inner shield members;

wherein the inner shield engagement members wipe across the inner shield members to remove any contaminants or oxides on the inner shield engagement members.

2. The electrical connector as recited in claim 1, wherein the shield receiving slots are provided proximate the periphery of the shield receiving area, the shield receiving slots extend from proximate a mating connector receiving face of the housing to proximate a bottom wall of the housing.

3. The electrical connector as recited in claim 1, wherein stabilization members extend outward from the first side wall and the second side wall, the stabilization members provide the housing with a larger footprint, to provide stability to housing.

4. The electrical connector as recited in claim 1, wherein solder clip retention projections extend from the end walls proximate a bottom wall of the housing.

5. The electrical connector as recited in claim 4, wherein solder clips are positioned on the solder clip retention projections, the solder clips are configured to be soldered to a substrate to secure the housing to the substrate and to provide support to the housing and allow the housing to withstand pulling forces in all directions without dislodging the housing from the substrate.

6. The electrical connector as recited in claim 1, wherein a first row of shield receiving openings is proximate to, but spaced from, a mating connector receiving face of the housing, a second row of shield receiving openings is proximate to, but spaced from, a bottom wall of the housing.

7. The electrical connector as recited in claim 1, wherein edges of the inner shields are positioned in shield receiving slots of the first side wall.

8. The electrical connector as recited in claim 1, wherein the inner shield engagement members include arms with facing projections, the spacing between the facing projections is less than a thickness of the mating sections of the inner shields.

9. The electrical connector as recited in claim 1, wherein the inner shield engagement members include slots with facing edges, the slots are dimensioned to be smaller than a thickness of the mating sections of the inner shields.

10. The electrical connector as recited in claim 1, wherein the inner shield engagement members include a first row of inner shield engagement members positioned to be received in a first row of shield receiving openings, a second row of inner shield engagement members is positioned to be received in a second row of shield receiving openings, the first row of inner shield engagement members and the second row of inner shield engagement members are formed in opposite directions, forming an inner shield receiving slot between the first row of inner shield engagement members and the second row of inner shield engagement members.

11. The electrical connector as recited in claim 1, wherein the inner shield members have outer shield engagement projections which extend from edges of the mating sections, the outer shield engagement projections extend through the shield receiving openings and are provided in electrical and mechanical engagement with the outer shield member.

12. The electrical connector as recited in claim 1, wherein a plurality of outer shield members are provided on the housing, a plurality of planar outer shields extend between respective outer shield member, the planar outer shields have resilient projection which are provided in electrical and mechanical engagement with adjacent outer shield members to provide shielding across the first side surface of the housing.

13. The electrical connector as recited in claim 1, wherein outer shield receiving projections extend from the first side wall proximate a bottom wall of the housing, the outer shield receiving projections are configured to receive and properly position the outer shield member.

* * * * *